United States Patent [19]

Sugimoto et al.

[11] 4,233,585

[45] Nov. 11, 1980

[54] PLUNGER TYPE ELECTROMAGNET

[75] Inventors: Shun-ichiro Sugimoto; Hisazi Shinoki, both of Katsuta, Japan

[73] Assignee: Hitachi, Ltd., Japan

[21] Appl. No.: 18,735

[22] Filed: Mar. 8, 1979

[30] Foreign Application Priority Data

Mar. 10, 1978 [JP] Japan ..... 53-26560

[51] Int. Cl.[3] ..... H01F 7/08

[52] U.S. Cl. ..... 335/262; 335/255

[58] Field of Search ..... 335/255, 257, 258, 260, 335/262

[56] References Cited

U.S. PATENT DOCUMENTS

| | | | |
|---|---|---|---|
| 3,510,814 | 5/1970 | Nordfors | 335/262 |
| 4,153,890 | 5/1979 | Coors | 335/260 |

FOREIGN PATENT DOCUMENTS

| | | | |
|---|---|---|---|
| 41-14036 | 6/1966 | Japan | 335/262 |
| 264556 | 3/1970 | U.S.S.R. | 335/255 |

*Primary Examiner*—George Harris

*Attorney, Agent, or Firm*—Craig & Antonelli

[57] ABSTRACT

An electromagnet of the plunger type is disclosed which includes a plunger body and a guide for guiding the plunger body in its sliding movement. The plunger body is formed with a resin coat on the surface thereof which is brought into sliding contact with the guide, and the guide is formed with a resin at least in a portion thereof which is brought into sliding contact with the plunger body, so that in the electromagnet the magnetic resistance may be reduced and the sliding characteristics and the wear resisting property may be improved.

2 Claims, 1 Drawing Figure

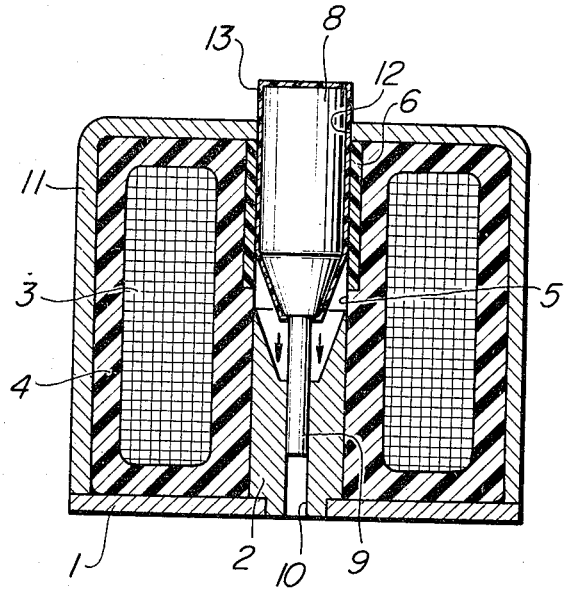
13
8
12
6
11
3
5
4
1
2
10
9

PLUNGER TYPE ELECTROMAGNET

BACKGROUND OF THE INVENTION

1. Field of the Invention

This invention relates to electromagnets of the plunger type, such as solenoids, contactors, etc., and more particularly to the improvements in the sliding parts of a plunger.

2. Description of the Prior Art

Japanese Utility Model Publication No. 14036/66 discloses a coil bobbin of a plunger type electromagnet wherein the coil bobbin formed of a synthetic resinous material is provided on its inner side with a layer of a synthetic resinous material, such as Nylon, Delrin, etc., which has a low coefficient of friction and high wear resisting property with respect to steel. In this type of coil bobbin, a plunger made of metal moves in sliding contact with the resin coated inner side of the coil bobbin. Therefore, the frictional force produced between the plunger and the resin coated inner side of the coil bobbin would be great and much wear would be caused on the slidingly contacting parts, so that the electromagnet would have the disadvantage of being short in service life.

In another electromagnet of the plunger type of the prior art, it is known that the sliding characteristics and wear resisting property can be improved by using a synthetic resinous material for forming the contact surfaces of both the plunger body and the guide (in some cases the inner wall surface of the coil is substituted therefor) for guiding the plunger body in sliding contact therewith. For this purpose proposals have been made to form a ring-shaped member of polyacetal resin which is fitted over a plunger body, in producing a plunger type electromagnet.

The plunger type electromagnet constructed as aforesaid is required to have the ring-shaped resin member of a thickness of at least 0.5 to 1.0 mm, in view of the problem arising in forming the resin into the ring-shaped member. As a result, the gap between the outer circumference of the plunger body and a yoke fitted over a coil is increased and magnetic resistance is increased, thereby injuring the characteristics of the electromagnet.

Also, difficulties are encountered in selecting suitable materials for forming the ring-shaped resin member fitted over the plunger body and the guide for guiding the plunger body. In our experiences, no satisfactory results have been obtained from the tests in which various materials were tested and such materials were subjected to 5,000,000 reciprocating sliding movements, for example.

SUMMARY OF THE INVENTION

An object of this invention is to provide a plunger type electromagnet having superb magnetic characteristics.

Another object of this invention is to provide a plunger type electromagnet including a plunger body and a guide which have the improved sliding characteristics and wear resisting property, so that the electromagnet has a longer service life than plunger type electromagnets of the prior art.

According to the invention, there is provided a plunger type electromagnet comprising a plunger body slidingly moved by an electromagnetic force, and a guide for guiding the plunger body in its sliding movement, wherein the improvement resides in applying a resin coat to a surface of the plunger body which surface is brought into sliding contact with the guide and in using a resinous material for forming at least a portion of the guide which portion is brought into sliding contact with the plunger body.

According to the invention, the layer of resin formed on the outer circumference of the plunger body is in the form of a coat and the resin coat has a very small thickness, so that the gap between the plunger body and the yoke fitted over the coil can be reduced, thereby minimizing the magnetic resistance offered by the gap.

According to another aspect of the invention, a coat of polyfluoroethylene is applied to a surface of the plunger body which is brought into sliding contact with the guide, and at least a portion of the guide which is brought into sliding contact with the plunger body is formed of polyacetal resin. Therefore it is possible to improve the sliding characteristics and wear resisting property of the plunger body and guide, thereby prolonging the service life of the electromagnet.

BRIEF DESCRIPTION OF THE DRAWING

The drawing shows a vertical sectional view of a plunger type electromagnet according to the invention.

DESCRIPTION OF THE PREFERRED EMBODIMENTS

The preferred embodiments of the invention will now be described with reference to the drawing, in which a base 1 made of iron or other magnetic material has located in its central portion a hub 2, made of iron and having an axial central bore 10, which hub is disposed in an upright position. A molded coil 4 including a predetermined number of turns of windings 3 molded with phenol, epoxy or other resin into a unitary body is fitted over the hub 2 by inserting the latter in a lower portion of an axial central bore 5 formed in the molded coil 4. Leadwires, not shown, are connected to the windings 3 of the molded coil 4 for applying current to the windings 3.

A guide 6 of the ring shape formed of polyacetal resin is force fitted in the upper portion of the bore 5 formed in the molded coil 4. A plunger body 8 made of iron and having a coat 13 of polyfluoroethylene (trade name, Teflon) applied to its circumference in a thickness of 10 to 20 $\mu$m is slidably inserted in the ring-shaped guide 6. The plunger 8 has secured to its lower end an iron rod 9 of a small diameter which extends through the bore 10 formed in the hub 2 for sliding movement therein.

A yoke 11 formed by deep drawing of sheet iron into a cylindrical shape and closed at one end is fitted over the outer periphery of the molded coil 4. The yoke 11 is formed in the center of its closed end with an opening 12 of a diameter large enough to permit the plunger body 8 having the aforesaid resin coat 13 to extend therethrough for free sliding movement.

In operation, when current is applied to the windings 3 of the molded coil 4, a magnetic circuit is formed through the hub 2, base 1, yoke 11 and plunger body 8 and back to the hub 2, so that the plunger body 8 is moved in a direction indicated by arrows. At this time, the resin coat 13 on the outer periphery of the plunger body 8 is brought into sliding contact with the guide 6, thereby permitting the smooth movement of the plunger body 8. The resin coat 13 is very small in thickness, so that the gap formed between the outer periphery of the plunger body 8 and the wall surface of the opening 12 formed in the yoke 11 is very small, thereby minimizing the magnetic resistance offered by the gap.

As aforesaid, the invention enables the gap between the yoke 11 and the plunger body 8 to be minimized, with the result that the magnetic resistance offered by the gap can be minimized and the characteristics of the electromagnet can be improved. If the characteristics of an electromagnet of the invention are equal to those of electromagnets of the prior art, then in the former the size of the windings 3 of the molded coil 4 may be made smaller than the size of the latter, thereby enabling the external diameter of the electromagnet to be reduced. Moreover, when the plunger body 8 makes a reciprocating movement, the resin coat 13 formed of polyfluoroethylene is brought into sliding contact with the guide 6 which is formed of polyacetal resin. With this arrangement, sliding characteristics and wear resisting property of the slidingly contacting portions are greatly improved. Experiments were conducted in which the durability of an electromagnet of this invention was tested. The results show that the service life of the electromagnet is increased fivefold (5,000,000 reciprocating sliding times) as compared with electromagnets of the prior art.

In the embodiment described hereinabove, the guide 6 has been described as being ring-shaped. However, the invention is not limited to this specific form of the guide 6, and the guide may be composed of a plurality of rod-like members arranged vertically in a predetermined spaced relationship on the circumference of a circle so as to guide the plunger body 8 along the inner surfaces of the members. Also, in the embodiment described above, the invention has been described as having the guide 6 formed of polyacetal resin and as having the resin coat 13 formed of polyfluoroethylene. However, the guide may be formed of polyfluoroethylene and the resin coat 13 may be formed of polyacetal resin. It is to be noted that the use of polyfluoroethylene for forming the resin coat 13 offers the advantage of reducing production cost by economizing on this expensive resinous material. Also, the guide 6 may be formed of epoxy or other resin and the resin coat 13 may be formed of polyacetal resin, polyfluoroethylene or other resin. However, the results of experiments have shown that these combinations of resins give a shorter service life to the plunger type electromagnet than the combination of resins described in the first-mentioned embodiment of the invention. Be that as it may, coating the plunger body 8 with a resin to form the resin coat 13 is highly advantageous in improving the magnetic characteristics of a plunger type electromagnet, if no long service life is required.

What is claimed is:

1. A plunger type electromagnet comprising:

a plunger body slidingly moved by an electromagnetic force; and a guide for guiding said plunger body in its sliding movement; wherein the improvement resides in applying a resin coat to a surface of said plunger body which surface is brought into sliding contact with said guide, and in using a resinous material for forming at least a portion of said guide which portion is brought into sliding contact with said plunger body.

2. A plunger type electromagnet as set forth in claim 1, wherein said resin coat applied to said plunger body is formed of polyfluoroethylene, and the resinous material used for forming at least the portion of said guide which portion is brought into sliding contact with said plunger body is formed of polyacetal resin.

* * * * *